United States Patent [19]

Aubry et al.

[11] 4,357,210

[45] Nov. 2, 1982

[54] ELECTRIC FURNACE FOR THE CALCINATION OF CARBONACEOUS MATERIALS

[75] Inventors: Michel Aubry, LeFayet; Jean-Claude Bernard, Ste Foy les Lyon; Paul Philipon, St. Etienne, all of France

[73] Assignee: Societe des Electrodes et Refractaires Savoie/SERS, Paris, France

[21] Appl. No.: 227,052

[22] PCT Filed: Jun. 8, 1979

[86] PCT No.: PCT/FR79/00049

§ 371 Date: Feb. 8, 1981

§ 102(e) Date: Dec. 30, 1980

[87] PCT Pub. No.: WO80/02740

PCT Pub. Date: Dec. 11, 1980

[51] Int. Cl.[3] ..... C10B 3/00; C10B 19/00; C10B 21/00

[52] U.S. Cl. ..... 202/85; 201/19; 201/27; 201/34; 202/99; 202/215; 373/115; 373/110

[58] Field of Search ..... 201/19, 27, 29, 34, 201/36, 43; 202/85, 91, 99, 108, 215; 13/7

[56] References Cited

U.S. PATENT DOCUMENTS

| | | | |
|---|---|---|---|
| 1,366,458 | 1/1921 | Hoopes | 13/7 |
| 1,524,784 | 2/1925 | Bartolomeis et al. | 201/19 |
| 1,671,673 | 5/1928 | Doerschuk et al. | 201/19 |
| 1,975,259 | 10/1934 | Derby | 13/7 |
| 2,710,280 | 6/1955 | Borch | 201/19 |
| 2,757,129 | 7/1956 | Reeves et al. | 201/27 |
| 3,464,913 | 9/1969 | Berry | 201/27 |
| 3,705,086 | 12/1972 | Schmalfedd et al. | 201/34 |
| 4,025,610 | 5/1977 | Suzuki et al. | 13/7 |
| 4,251,323 | 2/1981 | Smith | 201/29 |

FOREIGN PATENT DOCUMENTS

| | | |
|---|---|---|
| 337326 | 5/1921 | Fed. Rep. of Germany . |
| 550053 | 5/1932 | Fed. Rep. of Germany . |
| 2254628 | 7/1925 | France . |
| 628168 | 6/1927 | France . |
| 1051895 | 9/1953 | France . |
| 1364540 | 5/1964 | France . |

*Primary Examiner*—Bradley Garris

*Attorney, Agent, or Firm*—Dennison, Meserole, Pollack & Scheiner

[57] ABSTRACT

The invention relates to an electric furnace for heating by passing a current through the charge, and more particularly, a continuous furnace in which the charge is a carbonaceous material.

The furnace according to the invention is provided with a device for allowing non-reactive gas to be circulated in the opposite direction to the charge.

The furnace according to the invention is used, in particular, for calcining anthracite.

2 Claims, 2 Drawing Figures

ELECTRIC FURNACE FOR THE CALCINATION OF CARBONACEOUS MATERIALS

The new furnace which is the object of the invention is of the type in which the charge to be treated acts as an electric resistance and is heated by passing a current directly through it. This furnace is suitable for the calcination of carbonaceous materials, in particular anthracite, with the aim of eliminating the volatile materials which they contain.

Electric furnaces for the calcination of anthracite by passing a current through the charge, of the type described in the left-hand column on page 1 of French Pat. No. 1,051,895, already exist. These furnaces comprise a vertical cylindrical shaft, inside which an anthracite charge is circulated continuously from top to bottom. The electric contact between the charge and the current inputs is provided by means of electrodes placed at the upper end and lower end of the furnace, generally in the axis.

During the heating treatment, the charged carbonaceous materials lose their humidity and then their volatile materials progressively, at a temperature which can range up to 1300° C., and the product which is extracted from the base of the furnace is particularly suitable for the manufacture of electrodes or of blocks of various shapes made of carbon or graphite.

As mentioned in the description of the cited patent, this type of furnace has several disadvantages. Firstly, the temperature to which the charge is brought is not at all homogeneous. The fraction of the charge which is located in the vicinity of the axis of the furnce reaches sufficient temperatures to transform it into graphite and this state is not desirable for the manufacture of carbonaceous pastes. On the other hand, the fraction of the charge which is located at the periphery of the furnace is poorly heated and is frequently incompletely degassed.

In practice, if the fraction of the charge of anthracite which is poorly degassed is to be reduced to a minimum, it is necessary to overheat a significant portion of that charge. This results in an increased consumption of electric energy on the order of 1200 KWH per ton of anthracite. Moreover, the volatile materials which distill are lost.

In French Pat. No. 1,051,895 which has already been cited, it has been proposed to use the volatile materials leaving the calcination furnace to carry out preheating of the anthracite before causing it to penetrate into the furnace.

This preheating can be carried out in a rotary furnace comprising burners which are supplied by the volatile materials originating from the electric furnace or in a vertical furnace in which the granules of anthracite are lowered through a stream of hot gas originating from the combustion of the volatile materials in a separate burner.

This process, which effectively improves the overall calcination yield, requires a relatively complex installation comprising two furnaces in series which are expensive to construct and relatively awkward to operate. In particular, it is necessary to avoid having an excess of combustive in the gaseous mixture in order not to oxidize the anthracite, and this can give rise to risks of explosion which are not negligible in the presence of large quantities of hydrogen. In addition, this device does not overcome the most serious disadvantage of the electric furnace which is the lack of homogeneity in the heating of the charge.

The new furnace which is the object of the invention allows the energy consumption of electric furnaces for the calcination of carbonaceous materials which have just been described to be reduced very significantly, while making it unnecessary to combine them with complex devices for preheating the charge. It also allows the homogeneity in the temperature of the charge to be improved to a certain extent and, finally, it allows the volatile materials liberated during calcination, all or the majority of which could be used for other applications, to be recovered.

The essential characteristics of this new furnace is that it comprises, in combination, a conventional means of heating by passing a current through the charge, a means of heat transfer formed by a heat-carrying gas which is unreactive toward the charge circulating in the opposite direction and a means of introduction of a determined quantity of a combustive gas.

It has been observed that, owing to the combination of these means, it is simultaneously possible to:

1. recover a significant proportion of the energy contained in the form of heat in the calcined materials which are extracted from the furnace;
2. improve the distribution of the temperature of the charge inside the furnace;
3. burn a small proportion of the volatile materials escaping, to decrease the electrical energy consumption and also to preheat the charge as soon as it enters the upper zone of the furnace, thus preventing the condensation in that zone of a part of the volatile materials; and
4. transfer to the exterior of the furnace the volatile materials which escape from the charge and collect them so that the majority of them can be used as source of energy for a wide variety of uses.

The figures below illustrate an embodiment of the invention in a nonlimiting manner.

Figure 1:
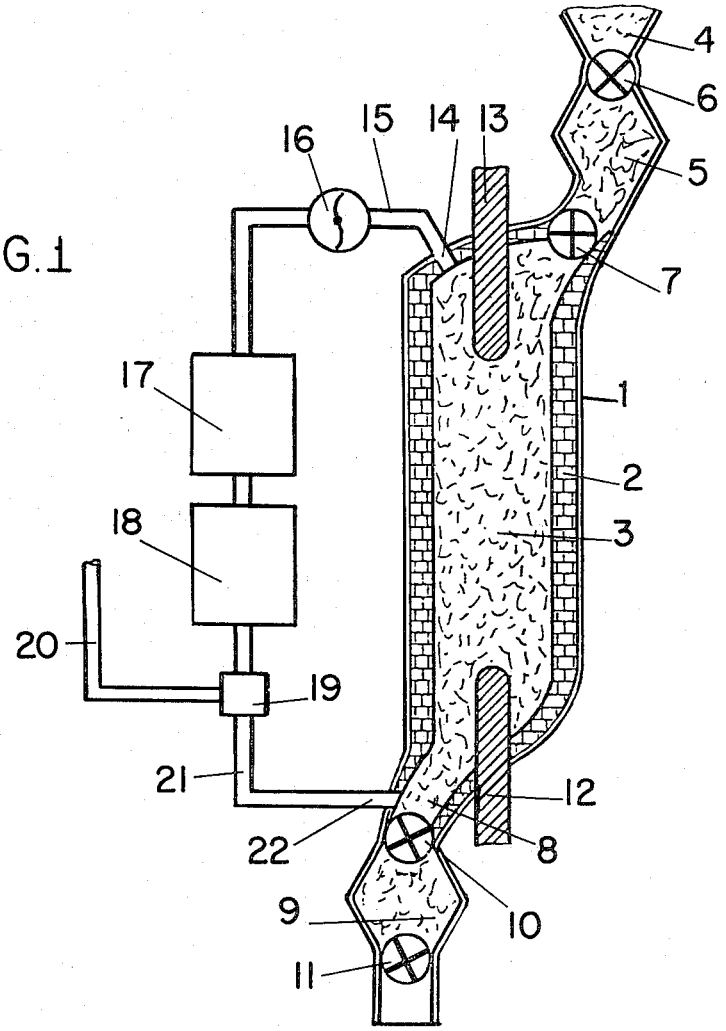
FIG. 1 represents a new furnace according to the invention in elevation and in cross section.

The electric furnace illustrated in FIG. 1 is constituted by a cylindrical sleeve 1 made of sheet steel provided with an internal lining of refractory material 2. The charge 3 is constituted by granules of anthracite which are introduced at the upper end of the furnace by means of a hopper 4 provided with a lock chamber 5 which is closed by two valves at the combined opening and closure 6 and 7.

The additions of anthracite needed to keep the furnace almost filled without too much gas being lost by passing through the lock chamber in the opposite direction are made by means of this device. At the lower portion, an outlet chute 8 is extended by a lock chamber 9 which is closed by two valves 10 and 11 with combined opening and closure at predetermined intervals so as to regulate the flow of the charge through the furnace at a sufficiently low speed to attain the desired degree of calcination.

Two graphite electrodes 12 and 13 are connected to current inputs (not shown), of which the voltage is adjusted so as to bring the charge to the temperature required to calcine the anthracite suitably, this temperature being on the order of 1200° to 1700° C. depending on the application.

An orifice 14 in the upper portion of the furnace is connected via a tube 15 to a fan 16 which draws the gases extracted from the furnace and passes them through a condenser 17 which is cooled, for example, by the circulation of water, in which are retained the tars and the hydrocarbon compounds which are liquid at ambient temperature. The uncondensed gases then pass through a washer 18 where the solid particles and also certain acid or other compounds are retained, then into a distributor 19 by means of which the excess fraction of gas is removed and directed via the tube 20 to other uses while the remainder of the gas is fed via the tube 21 to the orifice 22 at the base of the outlet chute 8 just above the valve 10. In this way, the gases which have thus been reintroduced into the furnace are largely freed from compounds containing oxygen such as water vapor and carbon dioxide, which could reoxidize the charge in part. When the furnace is in operation, the cold gases which penetrate through this orifice 22 meet the calcined anthracite which has been brought to a high temperature and is traveling toward the outlet chute. The heat exchange which takes place allows the anthracite to be cooled before it leaves the furnace to a temperature which can fall below 200° C. so as to prevent it from burning rapidly and to allow the gases circulating in the opposite direction to be brought to a high temperature. As they rise in the furnace, the gases which are very diffusive owing to their high hydrogen content promote a certain homogenization of the temperature by increasing the radial heat transfer between the zones close to the axis and the peripheral zones. At the same time, when they reach the upper zone of the furnace, these gases heat it considerably by exchanging their heat with the granules of anthracite which have just penetrated the furnace via the lock chamber 5 and the introduction valve 7. As they pass through the furnace in the opposite direction to the charge, the gases which are introduced mix with the volatile materials resulting from calcination and they increase in quantity per unit mass. If the temperature of the charge is sufficiently high in the upper zone of the furnace, all these gases leave the furnace through the orifice 14 and then perform the operating cycle already described. The flow rate of the gas stream which passes through the furnace is adjusted by using a fan 16 having suitable characteristics for the pressure to reach a sufficiently high value at the inlet orifice 22. This pressure depends essentially on the height of the charge of anthracite contained in the furnace and its ganulometry.

It is observed that, in the absence of leakage, the same quantity of gas invariably circulates in a closed circuit. As a result, the volatile materials which are liberated from the charge in permanent operation are recovered integrally outside the furnace, partly in the condenser 17 and the washer 18 and partly through the tube 20. This demonstrates that the gases which are circulated through the charge in the opposite direction act merely as a heat carrier which allows calories to be transferred from one region to another.

The reduction in consumption of electric energy which is observed when using a furnace of this type depends on quite a large number of factors such as its dimensions, its height to diameter ratio, the physical and physico-chemical characteristics of the anthracites or of any other carbonaceous materials which are treated. This reduction in consumption generally exceeds 50% and can be as high as 80% of the consumption of a conventional electric furnace for the calcination of anthracite.

At the same time, as shown, the quality of the calcined products is improved as they are more homogeneous and, finally, the volatile materials resulting from calcination are recovered. Yet it is difficult to prevent the volatile materials from condensing to a certain extent in the top portion of the furnace owing to the fact that the temperature of the charge is not quite high enough in this zone.

To avoid this drawback and also to decrease still further the electrical energy consumption, a limited quantity of combustion-supporting gas, oxygen or air, is injected into the furnace which allows a proportion of the volatile materials to be burned. This combustion causes the charge to be heated to an increased extent. By suitably adjusting the addition of combustion supporter, the temperature of the charge is brought to a sufficiently high level to prevent a proportion of the volatile materials from condensing and to allow this proportion to be entrained to the exterior of the furnace up to condenser.

Figure 2:
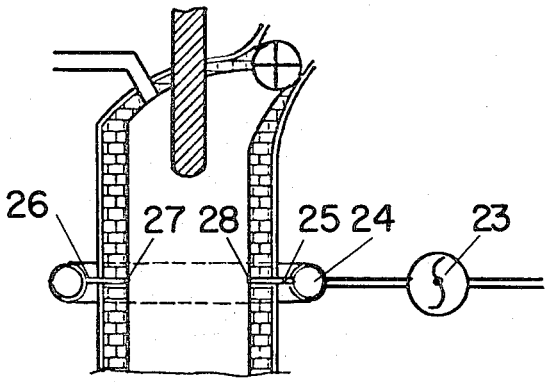
FIG. 2 represents a device for introducing some combustive into the upper zone of the furance.

FIG. 2 shows the upper portion of a furnace of the same type as the one shown in FIG. 1 provided with an air injection device. A fan 23 introduces some air into an annular tube 24 surrounding the upper portion of the furnace which is connected by radial piping 25–26 to orifices 27–28 passing through the wall of the furnace. A sufficient number of orifices is arranged all around the furnace to produce a suitable mixture of combustion supporter and combustible gas inside the furnace. The injection must be made in a sufficiently hot zone to cause self-ignition of the gases. In practice, the location of that zone depends on several factors and especially on the quantity of combustion supporting gas which is going to be injected. The gases are thus brought to a sufficiently high temperature to allow them to increase to a significant extent the temperature of the charge by contact during their journey to the outlet orifice 14 of the furnace. Beyond that orifice, the gases are treated in the conventional manner then invariably recycled, in part, in the same way.

Numerous variations can be made in the production of the new furnace according to the invention. Thus, the arrangement of the electrodes for heating the charge can be modified. In particular, it is possible to consider replacing one of the electrodes or both electrodes by a group of electrodes having a smaller cross-section arranged not axially but in the vicinity of the periphery by distributing them in a crown to avoid creating dissymmetry of heating. Thus, hollow electrodes, in the interior of which the heat-carrying gas will be injected, can be used, if necessary.

Finally, the same type of furnace can be used to heat different carbonaceous materials from anthracite such as, for example, charcoals, lignites, and any kind of coke. These carbonaceous materials can be introduced into the furnace as grains or granules of diverse sizes, or in compacted form such as briquettes or pellets.

We claim:

1. A furnace for the calcination of a charge of carbonaceous materials containing volatile materials comprising a vertical shaft provided with means for introducing carbonaceous materials into an upper zone and means for extracting the carbonaceous materials from a lower zone, said means maintaining during operation the shaft fully laden by the charge of carbonaceous materials, means including current inputs adapted to establish an electrical contact between the charge and said current inputs whereby an electric current passes longitudinally through said charge to effect resistance heating thereof, means external to said vertical shaft, for operatively connecting the upper zone of the furnace with the lower zone, comprising means for entraining reducing gases to be extracted from the upper zone for injection into the lower zone and including means for introducing at least a part of said gases extracted into the lower zone of the furnace, and means for injecting a combustion supporting gas into said upper zone of the shaft.

2. A furnace as in claim 1, wherein said means for injecting a combustion supporting gas are in communication with said upper zone of the furnace shaft such that said combustion supporting gas in operation of the furnace is introduced into a sufficiently hot zone of said furnace to cause self-ignition of the combustion supporting gas and volatile materials resulting from calcination.

* * * * *